US006007367A

United States Patent [19]

Gehbauer et al.

[11] Patent Number: 6,007,367

[45] Date of Patent: Dec. 28, 1999

[54] APPARATUS FOR CONNECTING CABLE CORES

[75] Inventors: Hermann Gehbauer, Vienna, Austria; Peter Meurers, Berlin, Germany

[73] Assignee: Krone AG, Germany

[21] Appl. No.: 09/189,529

[22] Filed: Nov. 10, 1998

[30] Foreign Application Priority Data

Nov. 21, 1997 [DE] Germany ..... 197 51 699

[51] Int. Cl.[6] ..... H01R 4/24

[52] U.S. Cl. ..... 439/402; 439/403

[58] Field of Search ..... 439/402, 403, 439/412, 413, 417

[56] References Cited

U.S. PATENT DOCUMENTS

| | | | |
|---|---|---|---|
| 3,985,416 | 10/1976 | Dola et al. | 439/403 |
| 4,127,312 | 11/1978 | Fleischhacker et al. | 439/403 |
| 4,552,429 | 11/1985 | Alst | 439/404 |
| 5,199,899 | 4/1993 | Ittah | 439/403 |

FOREIGN PATENT DOCUMENTS

| | | |
|---|---|---|
| 2 014 819 | 10/1971 | Germany . |
| 37 11 675 C2 | 4/1991 | Germany . |
| 295 20 259 U2 | 4/1996 | Germany . |
| 196 42 445 C1 | 3/1998 | Germany . |

*Primary Examiner*—Khiem Nguyen
*Assistant Examiner*—Michael K. Zarlow
*Attorney, Agent, or Firm*—McGlew and Tuttle, P.C.

[57] ABSTRACT

An apparatus for connecting cable cores, in particular using insulation displacement connection technology, in particular for producing a branch lead from a primary cable, comprising an insulating body with contact holders. A connecting element 3 is introduced into the contact holders 2 of the insulating body 1 and has two contact elements 5, 6 in different wiring connection levels, at least one contact element 6 being connected to a slide 4 which is guided in the connecting region such that it can move and can be pushed in the wiring connection direction into the contact slot 19 in the contact element 6.

11 Claims, 2 Drawing Sheets

APPARATUS FOR CONNECTING CABLE CORES

FIELD OF THE INVENTION

The invention relates to an apparatus for connecting cable cores, in particular using insulation displacement termninal connection technology, for producing a branch lead from a primary cable using an insulating body with contact holders.

BACKGROUND OF THE INVENTION

Core connectors for producing branch leads are already known from telecommunications. DE 37 11 675 C2 describes a core connector for cable cores of telecommunications cables, which essentially comprises two cover parts which can be latched to a housing lower part in different positions and into which guide channels for cable cores are introduced. Connecting elements are arranged in the guide channels. In order to produce a branch lead from a primary cable core, the cable core which is to form a branch lead is initially brought into contact, by means of one of the covering parts, with one of the insulation displacement contact slots in the connecting element. The cable core from the primary cable is then placed on the one cover part, which is latched onto the housing lower part, and the second cover part is used to introduce it into the second insulation displacement contact slot in the connecting element, such that electrically conductive contact is made.

A cable core branch lead from a cable core passing through is produced subject to the precondition that the cable core passing through has a certain amount of spare length so that it can be guided in a somewhat bent manner over the one cover part into the contact slot in the second insulation displacement contact.

SUMMARY AND OBJECTS OF THE INVENTION

The invention is based on the object of developing an apparatus of this generic type, by means of which a reliable branch lead can be produced from a continuous primary cable and in operation, without any special tool and without the primary cable needing to have any spare length.

This object is achieved by a body including a contact holder. A connecting element is positioned in the contact holder and the connecting element includes first and second contact means for connecting to the cables. The first contact means connects to a first of the cables at a first level. The first contact means includes a contact slot. The second contact means connects to a second of the cables at a second level. The first and second levels being different and spaced apart with respect to the axis of the respective cables in said first and second contact means. A slide has means for receiving the first cable. The slide also has means for sliding into the body and connecting the core of the first cable to the first contact means during the sliding by pushing the first cable into the contact slot of the first contact means.

The design of the contact element according to the invention, in particular with two mutually parallel contact elements in different wiring connection levels, and the design of at least one slide into which the primary cable is inserted at the side, ensure the reliable forming of a branch lead from one or more cable cores even if the primary cable is routed tightly in a cable duct and no spare lengths are available. No bends are required in the primary cable to make contact with the branch lead. The branch lead can be prepared at any desired point and can then make contact with the primary cable, in situ. The primary cable may at the same time be live and remain fully operational.

The slide is guided such that it can move either by finger pressure or by using any desired auxiliary tool, and ensures that contact is made with the cable core without using any tools, for example in the form of a screwdriver.

In one advantageous embodiment, two slides are provided, the other slide being used to make contact between the cable core which is to form a branch lead and the lower contact slot in an insulation-piercing terminal contact or insulation displacement contact (IDC). This slide is advantageously provided with an opening through which it is possible to look in order to inspect the position of the cable core which is to form a branch lead, to ensure that a reliable contact has been made.

In one preferred embodiment, the connecting element is designed on one side as an insulation displacement contact element with a contact slot for making contact with a primary cable core. The other side of the connecting element has any desired design for connection to the cable core which is to form a branch lead, such as a screw connection, soldered joint or integral connection.

Further advantageous refinements of the invention result from the dependent claims.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
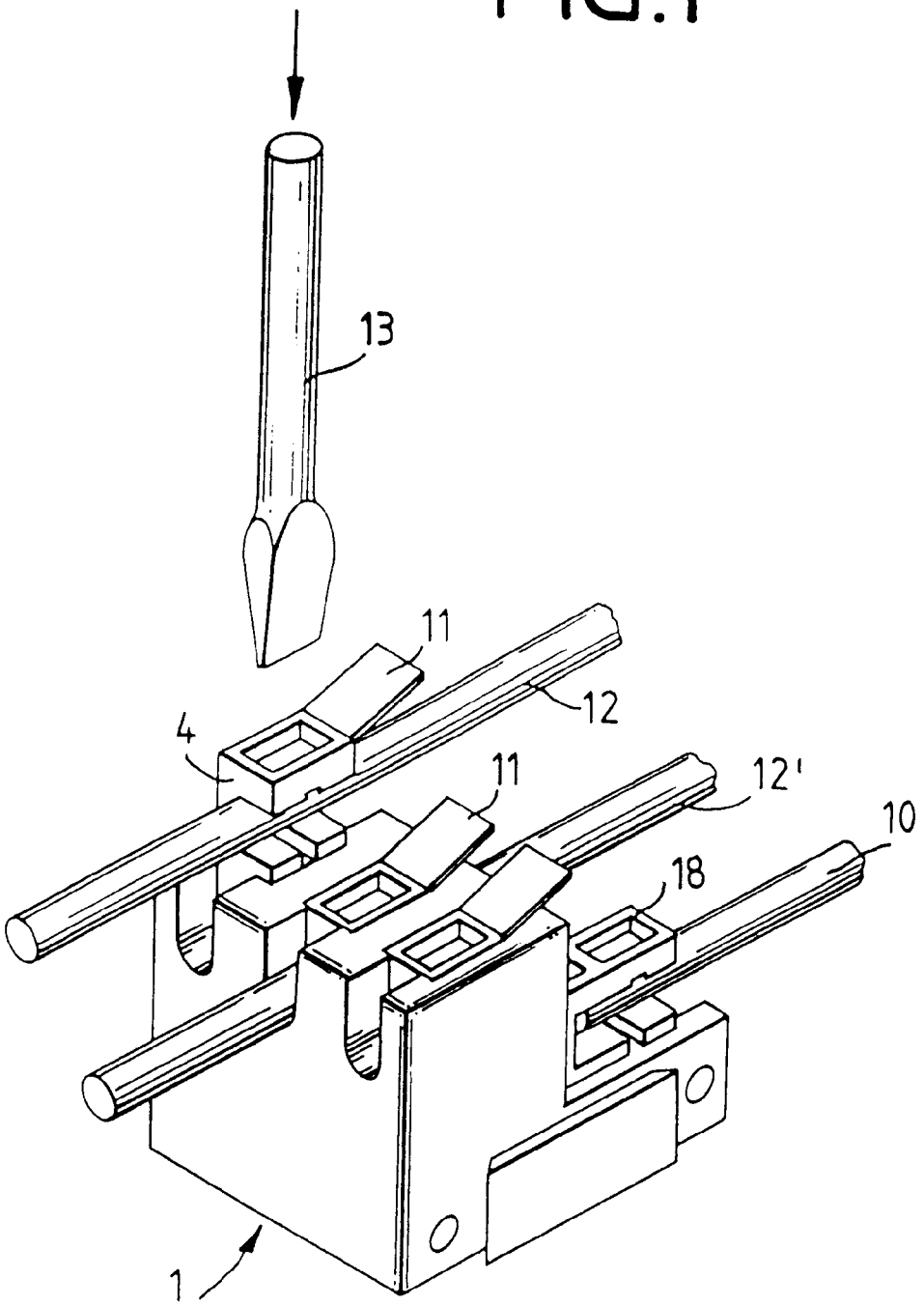
FIG. 1 is a perspective, schematic illustration of an apparatus as a module for a 3-core branch, with cable cores inserted.

Referring to the drawings, FIG. 1 illustrates an apparatus for forming a cable core branch lead from a primary cable, without interrupting the function of this cable, for a three-core cable. The apparatus may be produced in an equivalent manner as a 1-pole, 2-pole or multipole module in one piece, or by arranging any desired configurations in a row.

Figure 2:
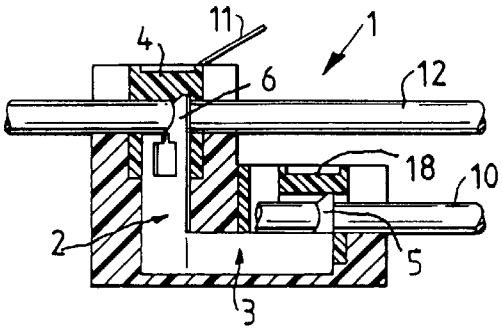
FIG. 2 is an illustration of a section through the apparatus according to FIG. 1.

In accordance with the illustration in FIGS. 1 and 2, the apparatus essentially comprises slides 4, 18, and an insulating body as a housing 1 into which connecting elements are introduced via contact holders 2. These connecting elements are designed as insulation displacement contacts 3.

Figure 4:
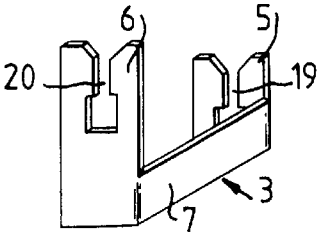
FIG. 4 is a perspective view of a connecting element designed as an insulation displacement contact element.

In accordance with the illustration in FIG. 4, each insulation displacement contact 3 comprises two contact means with contact elements 5, 6 having contact slots 19, 20 which are electrically conductively connected to one another via a connecting piece 7. The contact elements 5, 6, together with the contact slots 19, 20, are aligned parallel to one another. The contact-making levels in both contact slots 5, 6 are arranged vertically offset with respect to one another. Connecting elements 3 are preferably based on the LSA-plus technology (upgraded version of the German substation control and protection system). By virtue of this design of the contact slots 19, 20, there is less reduction in the cross sectional area of the cable core once contact is made, than in other insulation displacement contacts.

Figure 3:
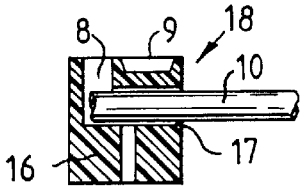
FIG. 3 is an illustration of a section through the slide corresponding to the illustration in FIGS. 1 and 2.

The wiring connection aid, which is called the slide 18, comprises, according to FIG. 3, an insulating body 16 having an opening 8 for visual inspection of the extent to which a cable core 10 has been introduced into the holding channel 17. The slide 18 also includes a fixing trough 9 for a tool, for example a screwdriver 13 (FIG. 1), which is inserted into the trough 9 in the direction of the arrow in FIG. 1 and is pressed down. The pressing down thus makes contact, for example, between the cable core 10 which is to form a branch lead and the insulation displacement contact slot 19. The other slide 4 has no opening 8, but an inscription area 11 for marking the cable core.

The slide 4 is used to make contact between the primary cable core 12 and the contact slot 20. The slide 18 is used to make contact between the end of cable core 10 which is to form a branch lead and the contact slot 19 of the insulation displacement contact element 3.

Figure 6:
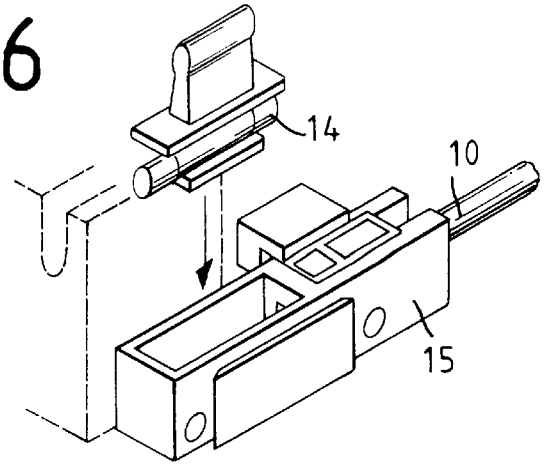
FIG. 6 is an exploded illustration of a fuse element.

The cable core 10 which is to form a branch lead may be protected by a fuse element 14, as illustrated in FIG. 6. The fuse element 14 is introduced into a fuse holder 15, which is arranged on the housing 1. The fuse element 14 makes contact with the insulation displacement contact element 3 via a contact strip, which is not illustrated.

In order to form a branch lead of, for example, the cable core 10 in FIG. 1, the end of cable core 10 which is to form a branch lead is initially inserted into the slide 18 at the side, and makes contact with the contact slot 19 by pressing the slide 18 down in the direction of the arrow (FIG. 1). It is then possible, via the opening 8 (FIG. 3), to inspect whether the core 10 has been inserted into the channel 17 as far as the stop, and that reliable contact is ensured. With the branch lead prepared in this way, the apparatus is brought to the primary cable. The primary cable is stripped using a special tool, which is not illustrated, and that insulating cable core 12 is selected to make the branch lead. The primary continuous cable core 12 is inserted into the slide 4 at the side (FIG. 1) and makes contact with the contact slot 20 (FIG. 3) by pressing the slide 4 down in the direction of the arrow (FIG. 1). This produces the electrical connection between the cable core 10 which is to form a branch lead and the primary cable core 12 (FIG. 2).

FIG. 1 shows the stages of the wiring connection process for producing a branch lead. In the upper phase, the primary cable 12 is inserted into the slide 4 at the side. In the following phase, the slide 4 is pressed down, and the cable core 12' makes contact with the insulation displacement contact element 3. The phase after this shows how the cable core 10 which is to form a branch lead is inserted into the slide 18 at the side.

The branch lead may, for example, have 3 poles in order to produce an electrical power supply through a plug socket from a cable duct. The three poles could also be a communication cable with a ringed line, a bus line, and a ground line. Alternatively the branch lead may be used to form a branch lead from a shielded data line.

The apparatus may have strain-relief means in order to allow, for example, free installation in cable runs.

The apparatus may have latching means in order, for example, to ensure latching onto top-hat rails.

Figure 5:
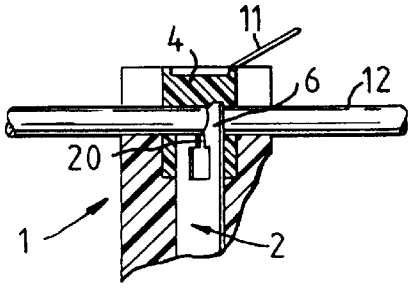
FIG. 5 is an illustration of a section through the apparatus, with respect to the connection of only the primary cable core.

In accordance with the illustration in FIG. 5, the apparatus may comprise just an insulating body 1 in which a contact holder 2 and a slide 4 are provided. An insulation displacement contact element 6 of a connecting element having a contact slot 20 is introduced into the contact holder 2 in order to make contact with a primary cable core 12, by means of the slide 4. The other side of the connecting element, which is not illustrated, has an electrically conductive connection for a cable core which is to form a branch lead (not illustrated). The connection between the insulation displacement contact element 6 and the cable core which is to form a branch lead may be a soldered joint, a screw connection, a crimped connection or any other connection, or else may have an integral design. This embodiment allows the cable core which is to form a branch lead to be prefabricated for any desired application, such as a plug socket, switch or the like, and then to be connected via the insulation displacement contact element 6 to the primary cable core 12, for example in a cable duct.

The apparatus is intended for use in low-voltage networks (220/380 V power supply), in telecommunications and data technology networks and in combinations of both network types in which, for example, data are interchanged via the power supply network.

While specific embodiments of the invention have been shown and described in detail to illustrate the application of the principles of the invention, it will be understood that the invention may be embodied otherwise without departing from such principles.

What is claimed is:

1. An apparatus for connecting cores of cables, the apparatus comprising:

a body including a contact holder;

a connecting element positioned in said contact holder, said connecting element including first and second contact means for connecting to the cables, said first contact means connecting to a first of the cables at a first level, said first contact means including a contact slot, said second contact means connecting to a second of the cables at a second level, said first and second levels being different;

a slide having means for receiving the first cable, said slide also having means for sliding into said body and connecting the core of the first cable to said first contact means during the sliding by pushing the first cable into said contact slot of said first contact means, said slide receiving a continuous length of the first cable.

2. The apparatus in accordance with claim 1, wherein:

said first and second contact means each include contact elements, said contact elements of said contact means each forming a plane, and said plane of said contact elements of said first contact means being substantially parallel to said plane of said contact elements of said second contact means.

3. The apparatus in accordance with claim 1, further comprising:

a contact slot in said second contact means;

a second slide having means for receiving the second cable, said second slide also having means for sliding into said body and connecting the core of the second cable to said second contact means during the sliding by pushing the second cable into said contact slot of said second contact means.

4. The apparatus in accordance with claim 1, wherein:

said slide includes means for receiving force from a screwdriver for the sliding into the body.

5. The apparatus in accordance with claim 3, wherein:

said second slide receives an end of the second cable.

6. The apparatus in accordance with claim 1, wherein:

said connecting element includes a fuse element connected electrically in series between said first and second contact means.

7. The apparatus in accordance with claim 1, wherein:

the cores of the cables are one of a ringed line, a bus line, and a ground line.

8. The apparatus in accordance with claim 1, wherein:

said body includes a plurality of said contact holders, a plurality of said connecting elements, and a plurality of said slides, said plurality of said contact holders are arranged in a row to form multipole modules in a form of strips.

9. The apparatus in accordance with claim 1, wherein:

said first contact means includes insulation piercing means for electrically connecting to the core of the cable by piercing through insulation of the cable.

10. An apparatus for connecting cores of cables, the apparatus comprising:

a body including a contact holder;

a connecting element positioned in said contact holder, said connecting element including first and second contact means for electrically connecting the cables, said first contact means connecting to a continuous length of a first of the cables, said second contact means connecting to an end of a second of the cables using an insulation piercing contact element;

a slide having means for receiving the continuous length of the first cable, said slide also having means for sliding into said body and connecting the core of the first cable to said first contact means during the sliding by pushing the first cable into said contact slot of said first contact means.

11. A wiring network comprising:

a plurality of continuous cables with cores;

a plurality of branch cables with cores and terminal ends;

a plurality of cable connection apparatus, each cable connection apparatus including a body including a contact holder, a connecting element positioned in said contact holder, said connecting element including first and second contact means for electrically connecting said cables, said first contact means connecting to one of said continuous cables, said second contact means connecting to one of said termination ends of said branch cables, a slide having means for receiving said one continuous cable, said slide also having means for sliding into said body and connecting a core of said continuous cable to said first contact means during the sliding by pushing said continuous cable into said first contact means.

* * * * *